US012601100B2

(12) United States Patent
Zhao et al.

(10) Patent No.: US 12,601,100 B2
(45) Date of Patent: Apr. 14, 2026

(54) CLOTHING TREATMENT AGENT BOX AND CLOTHING TREATMENT DEVICE

(71) Applicants: QINGDAO HAIER LAUNDRY ELECTRIC APPLIANCES CO., LTD, Qingdao (CN); Haier Smart Home Co., Ltd., Qingdao (CN)

(72) Inventors: Zhiqiang Zhao, Qingdao (CN); Sheng Xu, Qingdao (CN); Peishi Lv, Qingdao (CN)

(73) Assignees: QINGDAO HAIER LAUNDRY ELECTRIC APPLIANCES CO., LTD, Qingdao (CN); Haier Smart Home Co., Ltd., Qingdao (CN)

( * ) Notice: Subject to any disclaimer, the term of this patent is extended or adjusted under 35 U.S.C. 154(b) by 71 days.

(21) Appl. No.: 18/710,306

(22) PCT Filed: Oct. 21, 2022

(86) PCT No.: PCT/CN2022/126659

§ 371 (c)(1),
(2) Date: May 15, 2024

(87) PCT Pub. No.: WO2023/082968

PCT Pub. Date: May 19, 2023

(65) Prior Publication Data

US 2025/0011996 A1 Jan. 9, 2025

(30) Foreign Application Priority Data

Nov. 15, 2021 (CN) ..... 202111348584.8
Nov. 15, 2021 (CN) ..... 202111350660.9

(51) Int. Cl.
*D06F 39/02* (2006.01)
*D06F 39/08* (2006.01)

(52) U.S. Cl.
CPC ..... *D06F 39/022* (2013.01); *D06F 39/02* (2013.01); *D06F 39/08* (2013.01)

(58) Field of Classification Search
CPC ..... D06F 39/02; D06F 39/022
See application file for complete search history.

(56) References Cited

U.S. PATENT DOCUMENTS

2013/0036775 A1 2/2013 Brueckner et al.

FOREIGN PATENT DOCUMENTS

CN 1641089 A 7/2005
CN 2753775 Y 1/2006
(Continued)

OTHER PUBLICATIONS

International Search Report mailed on Jan. 18, 2023, in corresponding International Application No. PCT/CN2022/126659, 6 pages.
(Continued)

*Primary Examiner* — Levon J Shahinian
(74) *Attorney, Agent, or Firm* — Maier & Maier, PLLC

(57) ABSTRACT

A clothing treatment agent box and a clothing treatment device, including a clothing treatment agent box body. A first cavity is provided in the interior of the clothing treatment agent box body, and a disinfection and sterilization apparatus is fixedly provided in the interior of the first cavity. A first water flow channel is further provided in the first cavity. The disinfection and sterilization apparatus includes a housing provided with a slow-release exchange hole that enables a water flow to make contact with a drug in the disinfection and sterilization apparatus. In the clothing treatment agent box, while disinfection and sterilization effects on clothing and of the clothing treatment device are satisfied, the drug may be slowly dissolved into washing water, thereby prolonging the service life of the disinfection and sterilization apparatus.

9 Claims, 3 Drawing Sheets

(56) References Cited

FOREIGN PATENT DOCUMENTS

| | | | |
|---|---|---|---|
| CN | 110359237 | A | 10/2019 |
| CN | 211368102 | U | 8/2020 |
| DE | 2409854 | A1 | 9/1975 |
| JP | 2002102590 | A | 4/2002 |
| JP | 2002331196 | A | 11/2002 |
| JP | 2003245498 | A | 9/2003 |
| JP | 2007061175 | A | 3/2007 |
| JP | 6745543 | B1 | 8/2020 |
| KR | 20110082771 | A | 7/2011 |

OTHER PUBLICATIONS

Office Action issued on Mar. 27, 2025, in corresponding Chinese Application No. 202111348584.8, 16 pages.
Office Action issued on Mar. 26, 2025, in corresponding Chinese Application No. 202111350660.9, 16 pages.

CLOTHING TREATMENT AGENT BOX AND CLOTHING TREATMENT DEVICE

FIELD

The present disclosure belongs to the technical field of clothing treatment, and specifically provides a clothing treatment agent box and a clothing treatment apparatus.

BACKGROUND

With the rapid social development and the acceleration of people's pace of life, people have also raised higher requirements on the comfort of life, which therefore has led to an increasing demand for clothing washing.

The existing clothing treatment apparatuses are usually provided with a clothing treatment agent box, which enables a clothing treatment agent to dissolve in and go with a washing water supplied from an external water source into a washing cylinder. However, with the long-term use of the clothing treatment apparatus, bacteria, molds, microorganisms and the like are likely to grow inside the clothing treatment apparatus, which can lead to the carrying of bacteria, molds and microorganisms on clothing to threat human health. Therefore, it is necessary to manually dispense a disinfectant into the clothing treatment agent box to achieve a disinfection effect on the clothing treatment apparatus.

Due to limitations in principle and structure, the existing clothing treatment agent boxes have the problem of being unable to achieve disinfection and sterilization of the interior of the clothing treatment apparatus in the process of the washing water flowing from the clothing treatment agent box to the clothing treatment apparatus.

Accordingly, there is a need for a new clothing treatment agent box and clothing treatment apparatus in the art to solve the above problem.

SUMMARY

In order to solve the above problem in the prior art, that is, to solve the problem that the existing clothing treatment agent boxes cannot achieve disinfection and sterilization of the interior of the clothing treatment apparatus in the process of the washing water flowing from the clothing treatment agent box to the clothing treatment apparatus, the present disclosure provides a clothing treatment agent box, which includes a clothing treatment agent box body, inside which a first chamber is arranged; a disinfection and sterilization device is fixedly arranged inside the first chamber, and a first water flow channel is further arranged inside the first chamber; the disinfection and sterilization device includes a shell, and the shell is further provided with a slow-release exchange hole for a water flow to come into contact with drugs in the disinfection and sterilization device.

In a preferred technical solution of the clothing treatment agent box described above, the disinfection and sterilization device is arranged above the first water flow channel, and a siphon pipe and a water blocking plate are arranged inside the first chamber; the water blocking plate divides the first chamber into a second chamber and a third chamber, with the second chamber being communicated with the third chamber through the siphon pipe; the second chamber is located on a side close to a handle of the clothing treatment agent box, the third chamber is located on a side away from the handle of the clothing treatment agent box, and the disinfection and sterilization device is arranged inside the third chamber.

In a preferred technical solution of the clothing treatment agent box described above, a fourth chamber that is separate from the first chamber is arranged inside the clothing treatment agent box body; the fourth chamber is configured for placing a detergent, and the second chamber is configured for placing a softener.

In a preferred technical solution of the clothing treatment agent box described above, a drug storage chamber is also arranged on an inner side of an upper wall of the shell, and an opening of the drug storage chamber faces the first water flow channel; a limiting protrusion is also arranged on the drug storage chamber, and the limiting protrusion is arranged to be capable of sequentially dispensing drugs in the drug storage chamber.

In a preferred technical solution of the clothing treatment agent box described above, an outer side of the drug is further wrapped with a packaging layer, and the packaging layer is any one of filter paper, non-woven fabric, or filter screen.

In a preferred technical solution of the clothing treatment agent box described above, the third chamber is further provided with an upper cover, which is provided with a siphon cap for use in cooperation with the siphon pipe, and the upper cover is further provided with a spray hole.

In a preferred technical solution of the clothing treatment agent box described above, a second water flow channel is further arranged inside the first chamber, and the first water flow channel and the second water flow channel are arranged one above the other; a quantitative water supply device is further arranged inside the first water flow channel, and the quantitative water supply device is arranged to be capable of supplying water from the first water flow channel into the second water flow channel at a set flow rate; the disinfection and sterilization device is arranged below the first water flow channel and above the second water flow channel.

In a preferred technical solution of the clothing treatment agent box described above, the quantitative water supply device includes a columnar water bucket, an upper end face of which is opened and fixedly connected to the first water flow channel, and a lower end face of which is arranged to be capable of timed opening and closing under the control of a sensor.

In a preferred technical solution of the clothing treatment agent box described above, the quantitative water supply device includes a flow meter and a water pump; the flow meter is arranged to be capable of detecting a total water flow in the first water flow channel, and the water pump is arranged to be capable of pumping the water from the first water flow channel to the second water flow channel at a set proportion.

The present disclosure also provides a clothing treatment apparatus, which includes the clothing treatment agent box according to any one of the above technical solutions.

It can be understood by those skilled in the art that in the technical solutions of the present disclosure, the clothing treatment agent box includes a clothing treatment agent box body, inside which a first chamber is arranged; a disinfection and sterilization device is fixedly arranged inside the first chamber, and a first water flow channel is further arranged inside the first chamber; the disinfection and sterilization device includes a shell, and the shell is further provided with a slow-release exchange hole for a water flow to come into contact with drugs in the disinfection and sterilization device.

Through the above arrangement, by arranging the first chamber inside the clothing treatment agent box body and fixedly arranging the disinfection and sterilization device inside the first chamber, the clothing treatment agent box of the present disclosure enables drugs to dissolve in the washing water and flow into the clothing treatment apparatus along with the washing water to achieve the disinfection and sterilization effect on the clothing and the clothing treatment apparatus. In addition, the clothing treatment agent box of the present disclosure is further provided with the slow-release exchange hole on the shell of the disinfection and sterilization device, which allows the water flow to come into contact with the drugs in the disinfection and sterilization device, so that the drugs can slowly dissolve in the washing water, thereby prolonging a service life of the disinfection and sterilization device.

BRIEF DESCRIPTION OF DRAWINGS

The clothing treatment agent box and the clothing treatment apparatus of the present disclosure will be described below with reference to the accompanying drawings. In the drawings.

DETAILED DESCRIPTION

Figure 1:
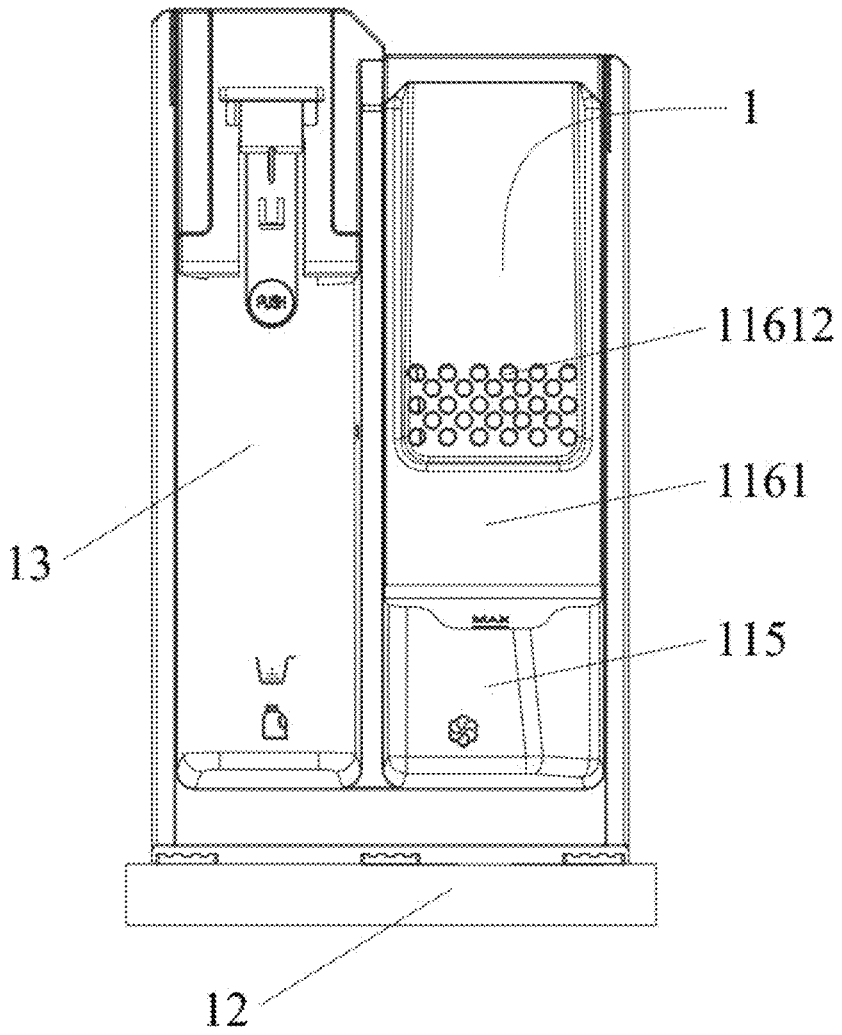
FIG. 1 is a schematic view of an overall structure of the clothing treatment agent box.

Preferred embodiments of the present disclosure will be described below with reference to the accompanying drawings. It should be understood by those skilled in the art that these embodiments are only used to explain the technical principle of the present disclosure, and are not intended to limit the scope of protection of the present disclosure. Those skilled in the art can make adjustments to these embodiments as required, so as to adapt to specific application scenes. For example, although the structure and arrangement position of the quantitative water supply device are described in the specification using an example in which the quantitative water supply device includes a columnar water bucket, an upper end face of the columnar water bucket is opened and fixedly connected to the first water flow channel, and a lower end face of the columnar water bucket is arranged to be capable of timed opening and closing under the control of a sensor, it is obvious that the present disclosure can adopt the structures and arrangement positions of various other quantitative water supply devices, as long as the structure and arrangement position of the quantitative water supply device enable the water to be quantitatively supplied to the second water flow channel. For example, the quantitative water supply device includes a flow meter and a water pump. The flow meter is arranged to be capable of detecting a total water flow in the first water flow channel, and the water pump is arranged to be capable of pumping the water from the first water flow channel to the second water flow channel at a set proportion.

It should be noted that in the description of the present disclosure, terms indicating directional or positional relationships, such as "upper", "lower", "inner", "outer" and the like, are based on the directional or positional relationships shown in the accompanying drawings. They are only used for case of description, and do not indicate or imply that the device or element must have a specific orientation, or be constructed or operated in a specific orientation; therefore, they should not be considered as limitations to the present disclosure. In addition, terms "first", "second", "third" and "fourth" are only used for descriptive purpose, and should not be understood as indicating or implying relative importance.

In addition, it should also be noted that in the description of the present disclosure, unless otherwise clearly specified and defined, term "connect" should be understood in a broad sense; for example, the connection may be a fixed connection, or may also be a detachable connection, or an integral connection; it may be a direct connection, or an indirect connection implemented through an intermediate medium. For those skilled in the art, the specific meaning of the above terms in the present disclosure can be interpreted according to specific situations.

The existing clothing treatment apparatuses are usually provided with a clothing treatment agent box, which enables the clothing treatment agent to dissolve in and go with the washing water supplied from an external water source into the washing cylinder. However, with the long-term use of the clothing treatment apparatus, bacteria, molds, microorganisms and the like are likely to grow inside the clothing treatment apparatus, which can lead to the carrying of bacteria, molds and microorganisms on clothing to threat human health. Therefore, it is necessary to manually dispense a disinfectant into the clothing treatment agent box to achieve a disinfection effect on the clothing treatment apparatus. Due to limitations in principle and structure, the existing clothing treatment agent boxes have the problem of being unable to achieve disinfection and sterilization of the interior of the clothing treatment apparatus in the process of the washing water flowing from the clothing treatment agent box to the clothing treatment apparatus.

Therefore, the present disclosure provides a new clothing treatment agent box; by arranging a first chamber inside a clothing treatment agent box body and fixedly arranging a disinfection and sterilization device inside the first chamber, drugs can dissolve in the washing water and flow into the clothing treatment apparatus along with the washing water to achieve the disinfection and sterilization effect on the clothing and the clothing treatment apparatus. In addition, the clothing treatment agent box of the present disclosure is further provided with a slow-release exchange hole on a shell of the disinfection and sterilization device, which allows the water flow to come into contact with the drugs in the disinfection and sterilization device, so that the drugs can slowly dissolve in the washing water, thereby prolonging a service life of the disinfection and sterilization device.

First, referring to FIGS. 1 to 2, the clothing treatment agent box of the present disclosure will be described.

Figure 2:
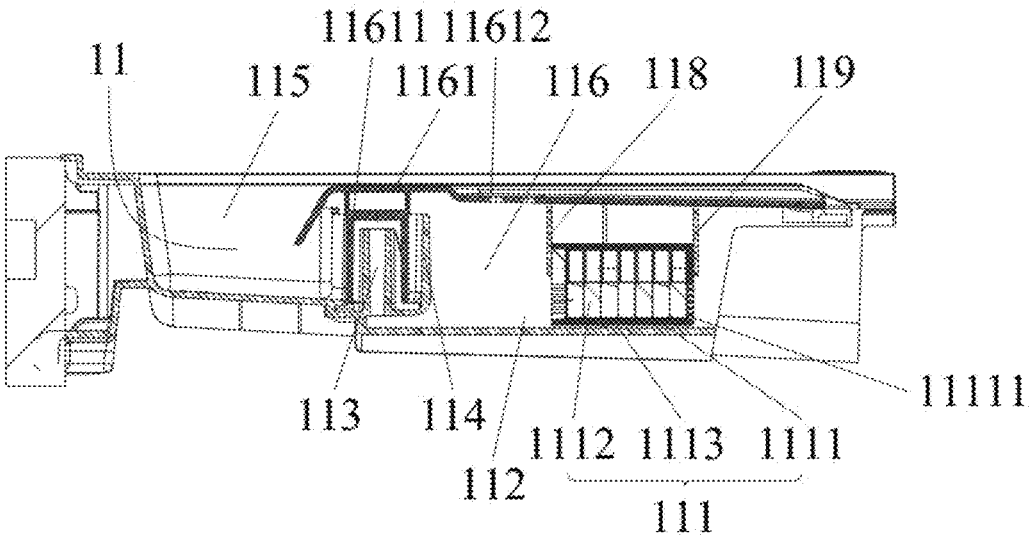
FIG. 2 is a schematic structural view of the first chamber of the clothing treatment agent box.

As shown in FIGS. 1 to 2, in order to solve the problem that the existing clothing treatment agent boxes cannot achieve disinfection and sterilization of the interior of the clothing treatment apparatus in the process of the washing water flowing from the clothing treatment agent box to the clothing treatment apparatus, the clothing treatment agent box of the present disclosure includes a clothing treatment agent box body 1, inside which a first chamber 11 is arranged; a disinfection and sterilization device 111 is fixedly arranged inside the first chamber 11, and a first water flow channel 112 is further arranged inside the first chamber 11; the disinfection and sterilization device 111 includes a shell 1111, and the shell 1111 is further provided with a slow-release exchange hole 11111 for a water flow to come into contact with drugs 1112 in the disinfection and sterilization device 111.

Through the above arrangement, by arranging the first chamber 11 inside the clothing treatment agent box body 1 and fixedly arranging the disinfection and sterilization device 111 inside the first chamber 11, the clothing treatment agent box of the present disclosure enables drugs 1112 to dissolve in the washing water and flow into the clothing treatment apparatus along with the washing water to achieve the disinfection and sterilization effect on the clothing and the clothing treatment apparatus. In addition, the clothing treatment agent box of the present disclosure is further provided with the slow-release exchange hole 11111 on the shell 1111 of the disinfection and sterilization device 111, which allows the water flow to come into contact with the drugs 1112 in the disinfection and sterilization device 111, so that the drugs 1112 can slowly dissolve in the washing water, thereby prolonging a service life of the disinfection and sterilization device 111.

It should be noted that in this embodiment, a first crossbeam 118 and a second crossbeam 119 are fixedly arranged inside the first chamber 11, and the disinfection and sterilization device 111 is snap-fitted with the first crossbeam 118 and the second crossbeam 119 respectively.

Next, with further reference to FIGS. 1 to 5, the clothing treatment agent box of the present disclosure will be described in detail.

As shown in FIGS. 1 to 2, in a possible embodiment, the disinfection and sterilization device 111 is arranged above the first water flow channel 112, and a siphon pipe 113 and a water blocking plate 114 are arranged inside the first chamber 11; the water blocking plate 114 divides the first chamber 11 into a second chamber 115 and a third chamber 116, with the second chamber 115 being communicated with the third chamber 116 through the siphon pipe 113; the second chamber 115 is located on a side close to a handle 12 of the clothing treatment agent box, the third chamber 116 is located on a side away from the handle 12 of the clothing treatment agent box, and the disinfection and sterilization device 111 is arranged inside the third chamber 116.

In this embodiment, the water blocking plate 114 is arranged inside the first chamber 11 to divide the first chamber 11 into the second chamber 115 and the third chamber 116, and the disinfection and sterilization device 111 is arranged inside the third chamber 116, so that the disinfection and sterilization device 111 and a detergent dispensing area are effectively separated. Moreover, the second chamber 115 and the third chamber 116 are communicated through the siphon pipe 113 to allow some detergent water to cross the water blocking plate 114 before flowing into the third chamber 116, and then flow through the disinfection and sterilization device 111 to achieve contact between the detergent water and the drugs 1112 through the slow-release exchange hole 11111 arranged on the disinfection and sterilization device 111, so that the drugs 1112 can slowly dissolve in the detergent water and flow into the clothing treatment apparatus along with the detergent water, thereby achieving the disinfection and sterilization effect on the clothing and the clothing treatment apparatus.

As shown in FIGS. 1 to 2, in order to further optimize the slow-release effect of the drugs 1112, in this embodiment, a fourth chamber 13 that is separate from the first chamber 11 is arranged inside the clothing treatment agent box body 1; the fourth chamber 13 is configured for placing a detergent, and the second chamber 115 is configured for placing a softener.

Through the above arrangement, the clothing treatment agent box of this embodiment enables the detergent and the softener to be placed separately, so as to ensure that the water flow separately dissolved with the softener flows through the disinfection and sterilization device 111 in the later stage of washing, avoiding that the water flow dissolved with the detergent flows through the disinfection and sterilization device 111 in the early stage of washing, thus reducing the contact between the water flow and the drugs 1112, reducing the dissolution of the drugs 1112, and prolonging the service life of the disinfection and sterilization device 111 while disinfecting and sterilizing the clothing and the clothing treatment apparatus.

Figure 3:
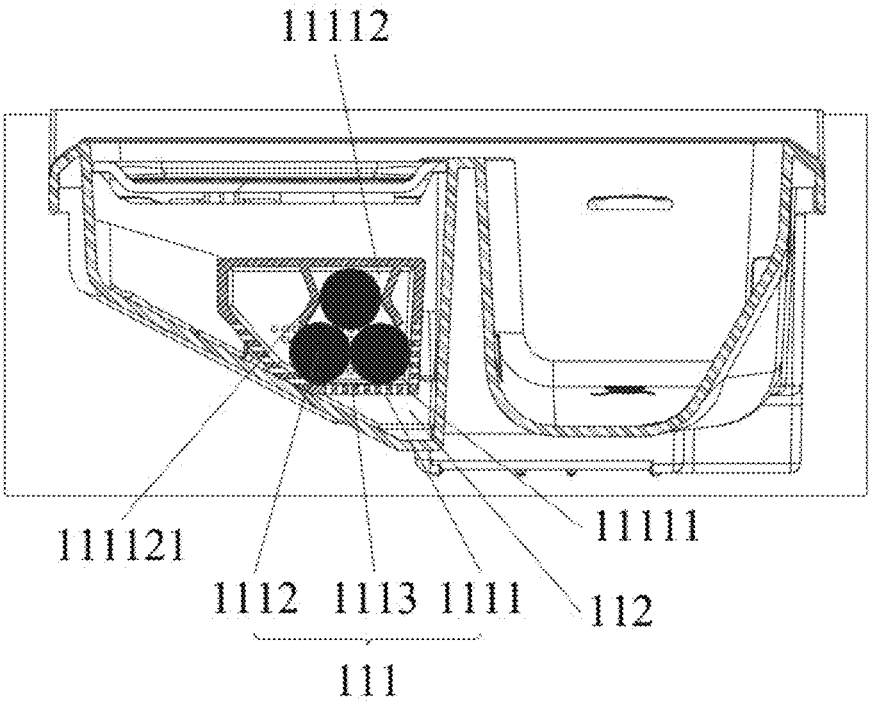
FIG. 3 is a schematic structural view of the arrangement of the disinfection and sterilization device inside the clothing treatment agent box.

As shown in FIG. 3, in a possible embodiment, a drug storage chamber 11112 is also arranged on an inner side of an upper wall of the shell 1111, and an opening of the drug storage chamber 11112 faces the first water flow channel 112; a limiting protrusion 111121 is also arranged on the drug storage chamber 11112, and the limiting protrusion 111121 is arranged to be capable of sequentially dispensing the drugs 1112 in the drug storage chamber 11112.

In this embodiment, by arranging the drug storage chamber 11112 on the inner side of the upper wall of the shell 1111 and arranging the limiting protrusion 111121 on the drug storage chamber 11112, sequential dispensing of the drugs 1112 in the drug storage chamber 11112 can be achieved, so as to meet the need for slow release of the drugs 1112.

As shown in FIG. 3, in order to further meet the need for slow release of the drugs 1112, in this embodiment, an outer side of the drug 1112 is further wrapped with a packaging layer 1113, and the packaging layer 1113 is any one of filter paper, non-woven fabric, or filter screen.

Through the above arrangement, the packaging layer 1113 arranged on the outer side of the drug 1112 effectively wraps the drug 1112, thus reducing the contact between the drug 1112 and the water flow to further achieve the slow-release effect of the drug 1112.

Figure 4:
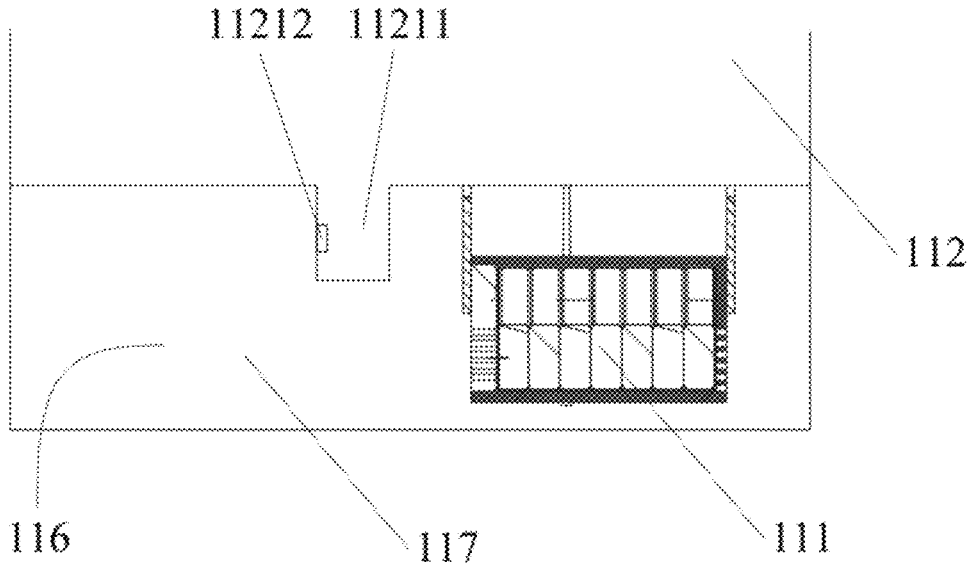
FIG. 4 is a schematic structural view of the third chamber provided with a columnar water bucket and a sensor.
Figure 5:
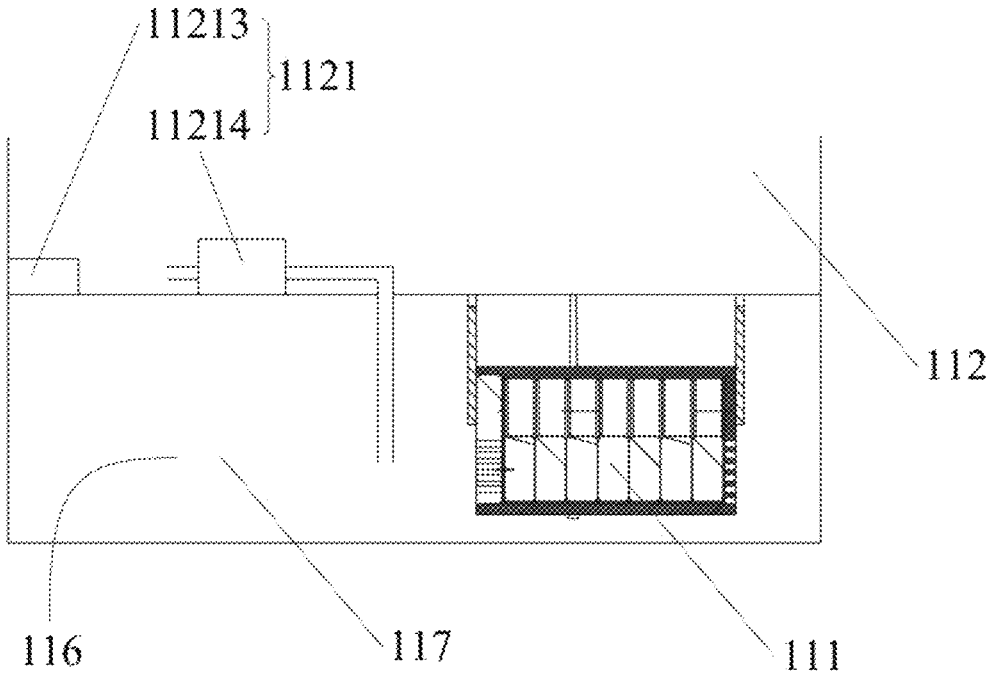
FIG. 5 is a schematic structural view of the third chamber provided with a water pump and a flow meter.

As shown in FIGS. 2, 4 and 5, in order to further reduce the contact between the water flow and the drugs 1112, in this embodiment, a second water flow channel 117 is further arranged inside the first chamber 11, and the first water flow channel 112 and the second water flow channel 117 are arranged one above the other; a quantitative water supply device 1121 is further arranged inside the first water flow channel 112, and the quantitative water supply device 1121 is arranged to be capable of supplying water from the first water flow channel 112 into the second water flow channel 117 at a set flow rate; the disinfection and sterilization device 111 is arranged below the first water flow channel 112 and above the second water flow channel 117.

In this embodiment, the first water flow channel 112 and the second water flow channel 117 arranged one above the other are provided inside the first chamber 11, and the quantitative water supply device 1121 is provided inside the first water flow channel 112; at the same time, the disinfection and sterilization device 111 is arranged below the first water flow channel 112 and above the second water flow channel 117, so that the quantitative water supply device 1121 can supply water from the first water flow channel 112 into the second water flow channel 117 at a set flow rate, thereby reducing the flow rate of water flowing through the second water flow channel 117 and therefore reducing the flow rate of water flowing through the disinfection and sterilization device 111, so as to reduce the contact between the water flow and the drugs 1112, and further reduce the amount of drugs 1112 dissolving in the water flowing through the disinfection and sterilization device 111 to improve the slow-release effect of the drugs 1112 and prolong the service life of the disinfection and sterilization device 111.

As shown in FIGS. 2 and 4, in this embodiment, the above quantitative water supply device 1121 includes a columnar water bucket 11211, an upper end face of which is opened and fixedly connected to the first water flow channel 112, and a lower end face of which is arranged to be capable of timed opening and closing under the control of a sensor 11212. Through the above arrangement, the columnar water bucket 11211 can collect the water flowing through the first water flow channel 112 into the columnar water bucket 11211, and the lower end face of the columnar water bucket 11211 is controlled by the sensor 11212 to open in a timed manner, so that the water in the columnar water bucket 11211 flows into the second water flow channel 117. Then, the lower end face of the columnar water bucket 11211 is controlled by the sensor 11212 to close in a timed manner, so that the water in the columnar water bucket 11211 no longer flows into the second water flow channel 117. Therefore, the sensor 11212 repeatedly controls the timed opening and closing of the lower end face of the columnar water bucket 11211 to achieve the quantitative output of water flow to the second water flow channel 117. Therefore, it is possible to quantitatively set the flow rate of water flowing through the second water flow channel 117 (i.e., quantitatively set the flow rate of water flowing through the disinfection and sterilization device 111) to reduce the contact between the water flow and the drugs 1112 in the disinfection and sterilization device 111, and avoid that all the water flowing through the first water flow channel 112 comes into contact with the disinfection and sterilization device 111, thus reducing the amount of drugs 1112 dissolving in the water flow and prolonging the service life of the disinfection and sterilization device 111.

It can be understood that although in this embodiment, the structure and arrangement position of the quantitative water supply device 1121 are described using an example in which the quantitative water supply device 1121 includes the columnar water bucket 11211, an upper end face of which is opened and fixedly connected to the first water flow channel 112, and a lower end face of which is arranged to be capable of timed opening and closing under the control of the sensor 11212, the structure and arrangement position of the quantitative water supply device 1121 in this embodiment are not limited to this; any structure and arrangement position of the quantitative water supply device 1121 are acceptable, as long as they can achieve the quantitative water supply to the second water flow channel 117. For example, the quantitative water supply device 1121 includes a flow meter 11213 and a water pump 11214; the flow meter 11213 is arranged to be capable of detecting a total water flow in the first water flow channel 112, and the water pump 11214 is arranged to be capable of pumping the water from the first water flow channel 112 to the second water flow channel 117 at a set proportion, as shown in FIGS. 2 and 5.

In this embodiment, the total water flow in the first water flow channel 112 is detected by the flow meter 11213, and the water in the first water flow channel 112 is pumped to the second water flow channel 117 at a set proportion by the water pump 11214 to achieve the quantitative output of water flow to the second water flow channel 117. Therefore, it is possible to quantitatively set the flow rate of water flowing through the second water flow channel 117 (i.e., quantitatively set the flow rate of water flowing through the disinfection and sterilization device 111) to reduce the contact between the water flow and the drugs 1112 in the disinfection and sterilization device 111, and avoid that all the water flowing through the first water flow channel 112 comes into contact with the disinfection and sterilization device 111, thus reducing the amount of drugs 1112 dissolving in the water flow and prolonging the service life of the disinfection and sterilization device 111.

As shown in FIG. 2, in a possible embodiment, the third chamber 116 is further provided with an upper cover 1161, which is provided with a siphon cap 11611 for use in cooperation with the siphon pipe 113, and the upper cover 1161 is further provided with a spray hole 11612.

In this embodiment, the siphon cap 11611 is used in cooperation with the siphon pipe 113 to better achieve a siphoning effect, and the second chamber 115 is communicated with the third chamber 116 through the siphoning effect to allow some detergent water to cross the water blocking plate 114 before flowing into the third chamber 116, and then flow through the disinfection and sterilization device 111 to achieve contact between the detergent water and the drugs 1112 through the slow-release exchange hole 11111 arranged on the disinfection and sterilization device 111, so that the drugs 1112 can slowly dissolve in the detergent water and flow into the clothing treatment apparatus along with the detergent water, thereby achieving the disinfection and sterilization effect on the clothing and the clothing treatment apparatus.

In summary, by arranging the first chamber 11 inside the clothing treatment agent box body 1 and fixedly arranging the disinfection and sterilization device 111 inside the first chamber 11, the clothing treatment agent box of the present disclosure enables the drugs 1112 to dissolve in the washing water and flow into the clothing treatment apparatus along with the washing water to achieve the disinfection and sterilization effect on the clothing and the clothing treatment apparatus. In addition, the clothing treatment agent box of the present disclosure is further provided with the slow-release exchange hole 11111 on the shell 1111 of the disinfection and sterilization device 111, which allows the water flow to come into contact with the drugs 1112 in the disinfection and sterilization device 111, so that the drugs 1112 can slowly dissolve in the washing water, thereby prolonging the service life of the disinfection and sterilization device 111.

Further, in the present disclosure, the first water flow channel 112 and the second water flow channel 117 arranged one above the other are provided inside the first chamber 11, and the quantitative water supply device 1121 is provided inside the first water flow channel 112; at the same time, the disinfection and sterilization device 111 is arranged below the first water flow channel 112 and above the second water flow channel 117, so that the quantitative water supply device 1121 can supply water from the first water flow channel 112 into the second water flow channel 117 at a set flow rate, thereby reducing the flow rate of water flowing through the second water flow channel 117 and therefore reducing the flow rate of water flowing through the disinfection and sterilization device 111, so as to reduce the contact between the water flow and the drugs 1112, and further reduce the amount of drugs 1112 dissolving in the water flowing through the disinfection and sterilization device 111 to improve the slow-release effect of the drugs 1112 and prolong the service life of the disinfection and sterilization device 111.

In addition, the present disclosure also provides two structures of the quantitative water supply device 112; that is, the quantitative water supply device 1121 includes the columnar water bucket 11211, an upper end face of which is opened and fixedly connected to the first water flow channel 112, and a lower end face of which is arranged to be capable of timed opening and closing under the control of the sensor 11212; alternatively, the quantitative water supply device 1121 includes the flow meter 11213 and the water pump 11214; the flow meter 11213 is arranged to be capable of detecting a total water flow in the first water flow channel 112, and the water pump 11214 is arranged to be capable of pumping the water from the first water flow channel 112 to the second water flow channel 117 at a set proportion.

It should be noted that the above embodiments are only used to illustrate the principles of the present disclosure, and are not intended to limit the scope of protection of the present disclosure. Without departing from the principles of the present disclosure, those skilled in the art can make adjustments to the above structures so that the present disclosure can be applied to more specific application scenes.

In addition, the present disclosure also provides a clothing treatment apparatus, which has the clothing treatment agent box as described in any of the above embodiments.

In addition, it can be understood by those skilled in the art that although some embodiments described herein include certain features included in other embodiments rather than other features, the combination of features from different embodiments means that the combination is within the scope of protection of the present disclosure and forms different embodiments. For example, in the claims of the present disclosure, any one of the claimed embodiments can be used in any combination.

Hitherto, the technical solutions of the present disclosure have been described in connection with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A clothing treatment agent box, comprising:

a clothing treatment agent box body, inside which a first chamber is arranged;

a disinfection and sterilization device is fixedly arranged inside the first chamber, and a first water flow channel is further arranged inside the first chamber;

wherein the disinfection and sterilization device comprises a shell, and the shell is further provided with a slow-release exchange hole for a water flow to come into contact with drugs in the disinfection and sterilization device; and wherein the disinfection and sterilization device is arranged above the first water flow channel, and a siphon pipe and a water blocking plate are arranged inside the first chamber; the water blocking plate divides the first chamber into a second chamber and a third chamber, with the second chamber being communicated with the third chamber through the siphon pipe; the second chamber is located on a side close to a handle of the clothing treatment agent box, the third chamber is located on a side away from the handle of the clothing treatment agent box, and the disinfection and sterilization device is arranged inside the third chamber.

2. The clothing treatment agent box according to claim 1, wherein a fourth chamber that is separate from the first chamber is arranged inside the clothing treatment agent box body; the fourth chamber is configured for placing a detergent, and the second chamber is configured for placing a softener.

3. The clothing treatment agent box according to claim 1, wherein a drug storage chamber is also arranged on an inner side of an upper wall of the shell, and an opening of the drug storage chamber faces the first water flow channel; a limiting protrusion is also arranged on the drug storage chamber, and the limiting protrusion is arranged to be capable of sequentially dispensing drugs in the drug storage chamber.

4. The clothing treatment agent box according to claim 3, wherein an outer side of the drug is further wrapped with a packaging layer, and the packaging layer is any one of filter paper, non-woven fabric, or filter screen.

5. The clothing treatment agent box according to claim 1, wherein the third chamber is further provided with an upper cover, which is provided with a siphon cap for use in cooperation with the siphon pipe, and the upper cover is further provided with a spray hole.

6. The clothing treatment agent box according to claim 1, wherein a second water flow channel is further arranged inside the first chamber, and the first water flow channel and the second water flow channel are arranged one above the other; a quantitative water supply device is further arranged inside the first water flow channel, and the quantitative water supply device is arranged to be capable of supplying water from the first water flow channel into the second water flow channel at a set flow rate; the disinfection and sterilization device is arranged below the first water flow channel and above the second water flow channel.

7. The clothing treatment agent box according to claim 6, wherein the quantitative water supply device comprises a columnar water bucket, an upper end face of which is opened and fixedly connected to the first water flow channel, and a lower end face of which is arranged to be capable of timed opening and closing under the control of a sensor.

8. The clothing treatment agent box according to claim 6, wherein the quantitative water supply device comprises a flow meter and a water pump; the flow meter is arranged to be capable of detecting a total water flow in the first water flow channel, and the water pump is arranged to be capable of pumping the water from the first water flow channel to the second water flow channel at a set proportion.

9. A clothing treatment apparatus, comprising the clothing treatment agent box according to claim 1.

* * * * *